US007868720B2

(12) United States Patent
Bush et al.

(10) Patent No.: US 7,868,720 B2
(45) Date of Patent: Jan. 11, 2011

(54) HERMETICALLY SEALED RELAY

(75) Inventors: Bernard Victor Bush, Santa Barbara, CA (US); Naveen Samuel Jesuraj, Bangalore (IN)

(73) Assignees: Tyco Electronics Corporation India, Bangalor (IN); Tyco Electronics Corporation, Middletown, PA (US)

( * ) Notice: Subject to any disclaimer, the term of this patent is extended or adjusted under 35 U.S.C. 154(b) by 434 days.

(21) Appl. No.: 11/933,493

(22) Filed: Nov. 1, 2007

(65) Prior Publication Data

US 2009/0114622 A1 May 7, 2009

(51) Int. Cl.

| | |
|---|---|
| ***H01H 1/66*** | (2006.01) |
| ***H01H 51/00*** | (2006.01) |
| ***H01H 9/20*** | (2006.01) |
| ***H01H 3/00*** | (2006.01) |
| ***H01H 13/04*** | (2006.01) |
| ***H01H 33/70*** | (2006.01) |
| ***H01H 33/02*** | (2006.01) |
| ***H01H 13/00*** | (2006.01) |

(52) U.S. Cl. ..... 335/151; 335/78; 335/106; 335/126; 335/152; 335/153; 335/154; 335/165; 335/185; 335/187; 335/196; 335/202; 218/68; 218/118; 218/155; 200/16 A

(58) Field of Classification Search ..... 335/78–86, 335/106, 124, 126, 128, 129, 130, 131, 132, 335/133, 136, 137, 151–154, 156, 159, 165, 335/185, 187, 189, 192, 194, 196, 197, 202, 335/203, 205–207, 248; 218/13, 68–78, 218/118–126, 155–157; 200/16 A, 123, 200/124, 125, 144 B, 218, 243, 302.1, 304, 200/305

See application file for complete search history.

(56) References Cited

U.S. PATENT DOCUMENTS 2,531,025 A * 11/1950 Bradley ..... 335/131

(Continued)

FOREIGN PATENT DOCUMENTS

WO WO 95/24051 9/1995

OTHER PUBLICATIONS

PCT International Search Report; International Application No. PCT/US2008/012275; International Filing Date Oct. 28, 2008.

*Primary Examiner*—Anh T Mai
*Assistant Examiner*—Mohamad A Musleh

(57) ABSTRACT

A hermetically sealed relay is provided having two circuits therein.

12 Claims, 5 Drawing Sheets

U.S. PATENT DOCUMENTS 2,569,776 A * 10/1951 Persons ..... 218/146
2,575,060 A * 11/1951 Matthias ..... 218/25
2,783,340 A * 2/1957 Davies et al. ..... 200/243
3,339,161 A * 8/1967 Conner et al. ..... 335/131
3,693,120 A * 9/1972 Quaal et al. ..... 335/128
4,048,600 A * 9/1977 Dietrich ..... 335/128
4,388,535 A * 6/1983 Wiktor et al. ..... 307/113
4,404,443 A * 9/1983 Coynel et al. ..... 218/23
4,427,863 A * 1/1984 Fujita ..... 200/306
4,430,579 A * 2/1984 Wiktor ..... 307/134
4,443,675 A * 4/1984 Drexler et al. ..... 200/243
4,755,706 A * 7/1988 Harnden et al. ..... 310/332
5,519,370 A * 5/1996 Perreira et al. ..... 335/154
5,546,061 A * 8/1996 Okabayashi et al. ..... 335/78
5,886,602 A * 3/1999 Burel et al. ..... 335/132
5,892,194 A * 4/1999 Uotome et al. ..... 218/68
5,982,259 A * 11/1999 Godfrey et al. ..... 335/177
6,265,955 B1 7/2001 Molyneux et al.
6,628,184 B1 * 9/2003 Cassagrande et al. ..... 335/132
6,911,884 B2 * 6/2005 Uotome et al. ..... 335/132
6,975,191 B2 * 12/2005 Ward ..... 335/18
7,145,422 B2 * 12/2006 Imanishi et al. ..... 335/201
2006/0260924 A1 11/2006 Liu et al.
2008/0030289 A1 * 2/2008 Kralik ..... 335/201
2008/0122562 A1 * 5/2008 Bush et al. ..... 335/153

* cited by examiner

HERMETICALLY SEALED RELAY

FIELD

The present disclosure is related generally to relays. The present disclosure is more specifically related to hermetically sealed relays.

BACKGROUND AND SUMMARY OF THE INVENTION

Hermetically sealed electromagnetic relays are used for switching of high electrical currents and/or high voltages, and typically have fixed and movable contacts, and an actuating mechanism supported within a hermetically sealed chamber. To suppress arc formation, and to provide long operating life, air is removed from the sealed chamber by conventional high-vacuum equipment and techniques. In one style of relay, the chamber is then sealed so the fixed and movable contacts contact in a high-vacuum environment. In another common style, the evacuated chamber is backfilled (and usually pressurized) with an insulating gas (e.g., sulphur hexafluoride, nitrogen, or gas mixes) with good arc-suppressing properties. These gases provide dielectric and arc suppression properties in addition to protecting the contacts from oxidation.

For purposes of this disclosure, a hermetic seal means a seal which is sufficiently strong and impermeable to maintain for a long term a high vacuum of $10^{-5}$ Torr (760 Torr=one atmosphere) or less, and a pressure of at least 1.5 atmospheres.

In one embodiment described below, a relay is provided including a hermetically sealed housing, a first circuit, a second circuit, and an actuator. The first circuit includes first and second fixed contacts and a first movable contact. The first movable contact and at least part of the first and second fixed contacts are sealed within the housing. The second circuit includes third and fourth fixed contacts and a second moveable contact. The second movable contact and at least part of the third and fourth fixed contacts are sealed within the housing. The second circuit is electrically isolated from the first circuit. The actuator is sealed within the housing. The actuator has a first position in which the moveable contact is electrically isolated from the first and second fixed contacts and the second moveable contact is electrically isolated from the third and fourth fixed contacts. The actuator has a second position in which the first moveable contact is electrically coupled to the first and second fixed contacts and the second moveable contact is electrically coupled to the third and fourth fixed contacts.

According to another embodiment of the present disclosure a relay is provided. The relay includes a first fixed contact; a first moveable contact, and at least one magnet. The first moveable contact is positionable in a first area proximate the first fixed contact and a second area away from the first fixed contact. The at least one magnet applies a flux to the first area. The flux achieves a first efficacy for arc blow out for a first polarity. The flux achieves a second efficacy for arc blowout for a second polarity. The first efficacy is substantially equal to the second efficacy and the first polarity is opposite of the second polarity.

According to yet another embodiment of the present disclosure, a relay is provided. The relay comprises a first moveable contact; a second moveable contact; a housing, the housing hermetically sealing the first and second moveable contacts therein; and a carrier containing the first and second moveable contacts, the carrier providing electrical isolation between the first and second moveable contacts, the carrier being moveable within and hermetically sealed within the housing.

DESCRIPTION OF THE DRAWINGS

Figure 1:
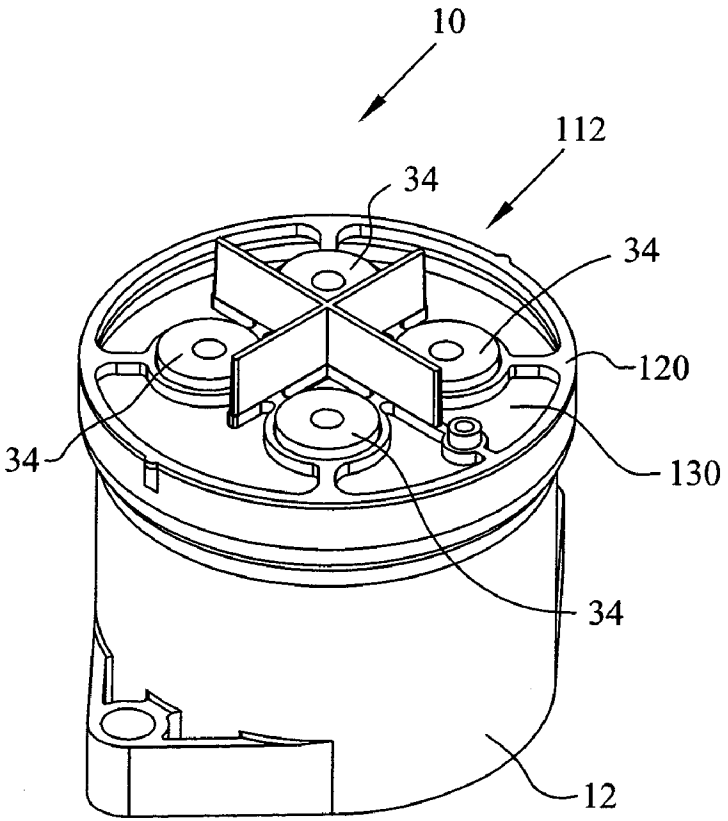
FIG. 1 is a perspective view of a hermetically sealed relay.

A hermetically sealed relay 10 is shown in FIG. 1. Relay 10 is described herein as a double-pull single throw normally open relay, but it should be appreciated that other orientations are envisioned that utilize concepts described herein. Relay 10 includes housing 12, outer core 14, and electrical assembly 16. Housing 12 is constructed from an epoxy plastic or other suitable material. Outer core 14 includes top core 46 and bottom core 48, all of which are constructed from steel.

Figure 2:
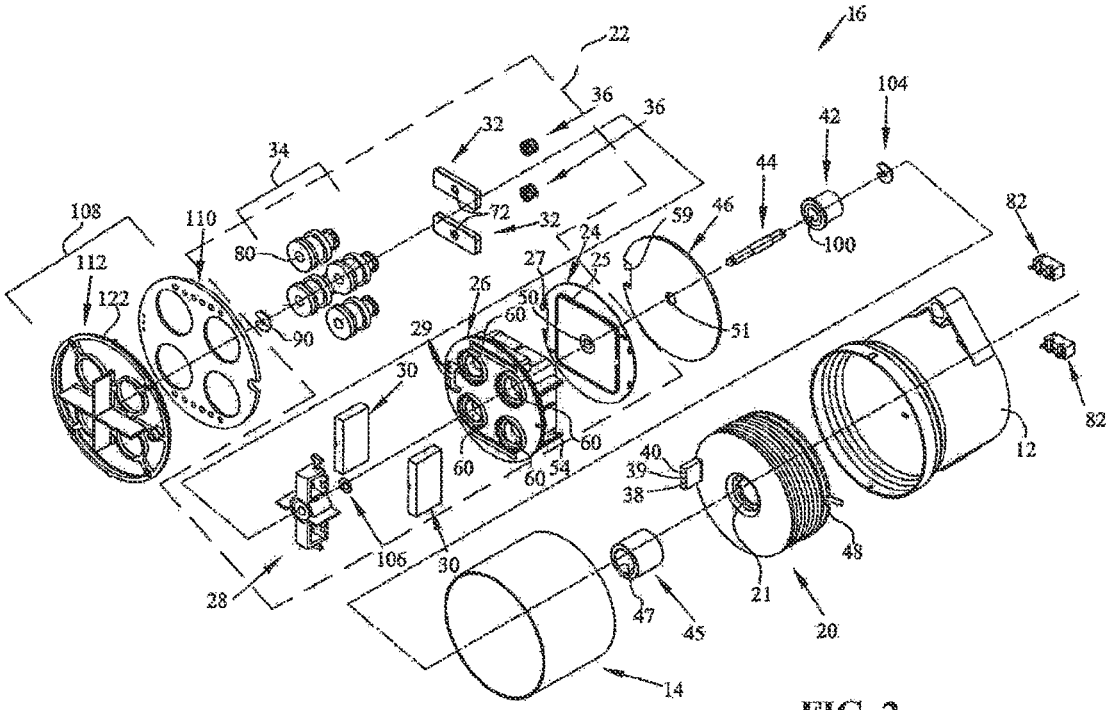
FIG. 2 is an exploded view of the relay of FIG. 1.

As shown in FIG. 2, electrical assembly 16 includes solenoid 20 and contact housing assembly 22. Contact housing assembly 22 includes guide 24, envelope 26, contact carrier 28, magnets 30, moving contacts 32, stationary contacts 34, and biasing springs 36. Solenoid 20 is a dual coil solenoid. Solenoid 20 includes activation coil and a hold coil which are activated by a plurality of leads 38, 39, 40. Solenoid 20 also includes plunger 42, shaft 44, and bearing 45 sized to be received within central bore 21 of solenoid 20. The coils are abutted above and below by top core 46 and bottom core 48, respectively. Top core 46 includes a central aperture 51 sized and shaped to allow shaft 44 to freely travel therein and includes lead notch 59 sized to allow plurality of leads 38, plurality of leads 39, and plurality of leads 40 to pass therethrough.

Figure 3:
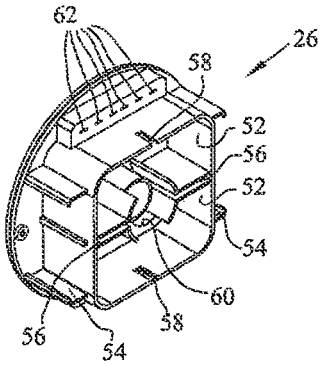
FIG. 3 is a perspective view of an envelope of the relay of FIG. 1.

Guide 24 of contact housing assembly 22 is substantially circular and constructed from Zytel® FR50 25% glass filled, or other non-conductive materials. Guide 24 has an outer diameter slightly less than the diameter of the diameter of top and bottom cores 46, 48. Similarly to top core 46, guide 24 includes a central aperture 50 sized and shaped to allow shaft 44 to travel therein and includes lead notch 27 sized to allow plurality of leads 38, 39, 40 to pass therethrough. Guide 24 also includes recesses 25 that are located to receive lower edges of envelope 26 therein, FIG. 3. Envelope 26 is constructed from Zytel® FR50 25% glass filled, but may be constructed from other non-conductive material. Envelope 26 includes two connection voids 52, two magnet slots 54, center carrier alignment voids 56, perimeter carrier alignment voids 58, lead bores 29, fixed contact voids 60 and a plurality of auxiliary switch voids 62. Connection voids 52 receive contact carrier 28 therein. Magnet slots 54 are sized and shaped to receive magnets 30 therein. Central carrier alignment voids 56 and perimeter carrier alignment voids 58 are adjacent the connection voids 52 and serve to align contact carrier 28 within connection voids 52. Fixed contact voids 60 partially receive stationary contacts 34 therein. Auxiliary switch voids 62 optionally house auxiliary switches as desired for particular uses of relay 10.

Figure 4:
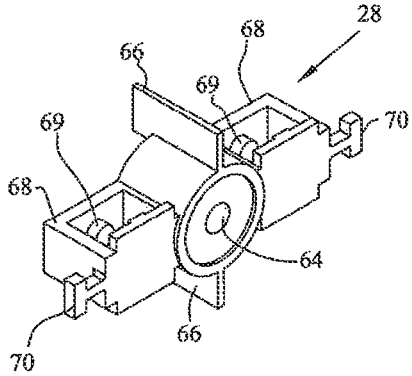
FIG. 4 is a perspective view of a contact carrier of the relay of FIG. 1.
Figure 5:
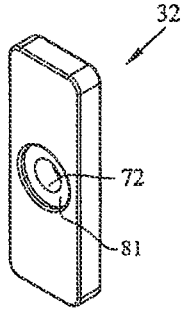
FIG. 5 is a perspective view of moveable contact of the relay of FIG. 1.

As shown in FIG. 4, contact carrier 28 includes shaft aperture 64 sized and shaped to receive shaft 44 therein. Contact carrier 28 further includes central alignment portions 66 sized and shaped to be received within central carrier alignment voids 56. Contact carrier 28 further includes contact holding portions 68 and perimeter alignment and activation tabs 70. Moving contacts 32, FIG. 5, are sized to be received within contact holding portions 68 of contact carrier 28. Moving contacts 32 include a central aperture 72 to align contacts 32 on posts 69 within carrier 28. Biasing springs 36 bias moving contacts 32 to abut inner surface of holding portions 68 of contact carrier 28. Moving contacts 32 further include spring seats 81 that are each sized to receive and retain ends of biasing springs 36 therein.

Figure 6:
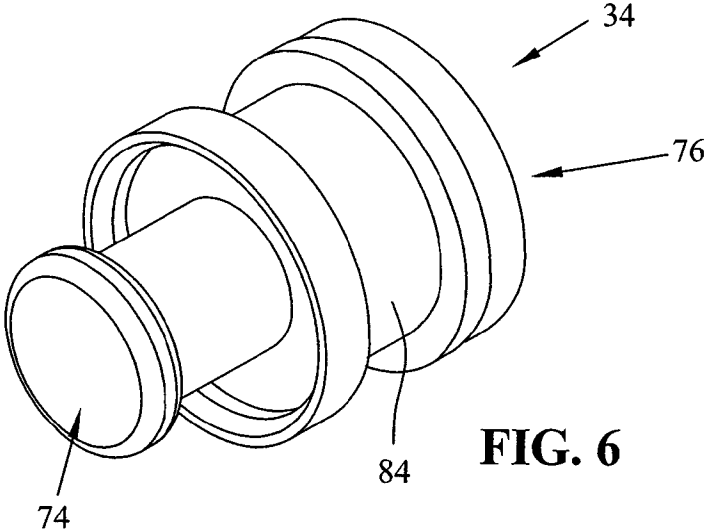
FIG. 6 is a perspective view of a fixed contact of the relay of FIG. 1.

Stationary contacts 34, FIG. 6, are constructed from copper or an approved substitute. Stationary contacts 34 include contact head 74 and neck portion 84 having a diameter sized to be received within fixed contact void 60 of envelope 26. Fixed contacts 34 also include a wire connection end 76 having a wire connection void 80 therein. Fixed contacts 34 are arranged into two sets of two contacts. Contact heads 74 of each fixed contact 34 in a contact set are disposed within a common connection void 52 of envelope 26. Accordingly, as discussed below, each connection void 52 has two contact heads 74 of a contact set disposed therein.

Top cap 108 includes top plate 110 and top frame 112. Top plate 110 is a substantially disk shaped circuit board. Top plate 110 includes four stationary contact holes 114 defined therein sized to provide solder points for stationary contacts 34. Top plate 110 further includes switch lead holes 116, solenoid lead holes 118, and tubulation clearance void 120 defined therein. Switch lead holes 116 allow leads for switches 82 to be soldered therein. Solenoid lead holes 118 likewise allow solenoid leads 38, 39, 40 to be soldered therein. Tubulation clearance void 120 is sized to permit an evacuation tube to be placed therethrough.

Plunger 42 is constructed from iron, and as such is magnetically responsive to fields created by the coils of solenoid 20. Plunger 42 includes inner bore 100 and has a first section with an outer diameter sized to be slidably received within inner bore 47 of bearing 45 and a second section with an outer diameter larger than inner bore 47.

Figure 7:
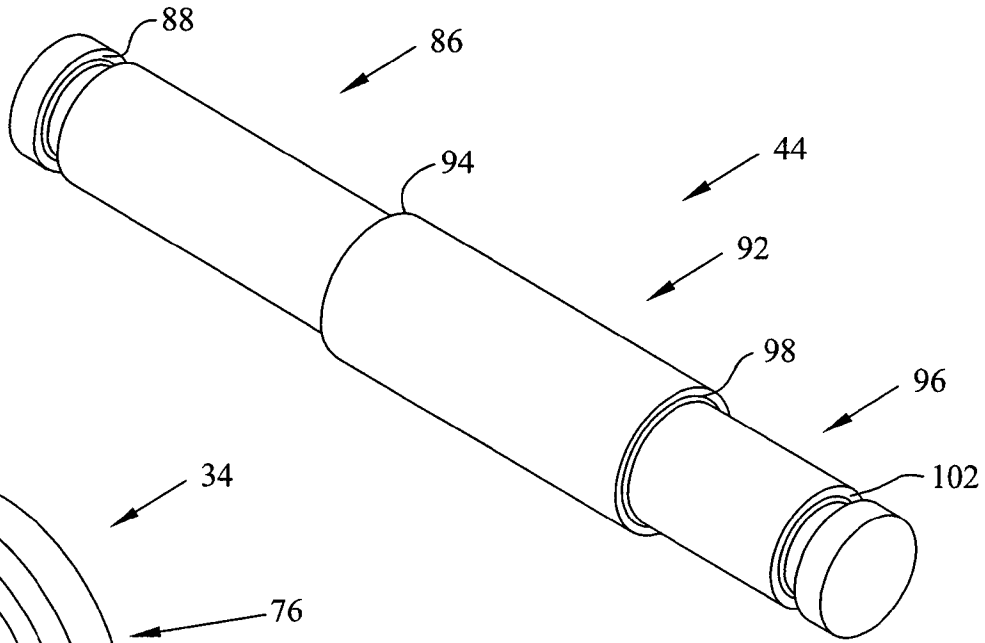
FIG. 7 is a perspective view of a shaft of the relay of FIG. 1.

Shaft 44, FIG. 7, is made from stainless steel, and as such is not magnetically responsive. Shaft 44 is a multi-diametered cylinder. Shaft 44 includes section 86 of a first diameter that is sized to be received within shaft aperture 64. Section 86 includes clip slot 88 near one end thereof sized and shaped to receive and retain clip 90 therein. Section 86 transitions to section 92 of greater diameter creating shoulder 94. Section 92 further transitions to section 96 of smaller diameter creating shoulder 98. Section 96 is sized to be received within inner bore 100 of plunger 42. Section 96 also includes clip slot 102 sized to receive clip 104 therein.

In assembly, moving contacts 32 are seated on posts 69 within contact holding portions 68 of contact carrier 28. Springs 36 are seated within contact holding portions 68 to bias moving contacts 32 therein. Washer 106 is then placed on section 86 of shaft 44 to seat upon shoulder 94. Section 86 is further placed within and extending from shaft aperture 64 of contact carrier 28. Clip 90 is then coupled within clip slot 88 to secure shaft 44 to contact carrier 28.

Magnets 30 are seated within magnet slots 54 of envelope 26. Similarly, stationary contacts 34 are seated within fixed contact voids 60 of envelope 26. Alternatively, envelope 26 is formed around stationary contacts 34. Assembled contact carrier 28 is placed within two connection voids 52 of envelope 26. Such placement includes placing central alignment portions 66 within center carrier alignment voids 56 and placing perimeter alignment and activation tabs 70 within perimeter carrier alignment voids 58. Switches 82 are coupled to plurality of auxiliary switch voids 62. Guide 24 is then coupled to envelope 26 by aligning the lower edge of envelope 26 within recesses 25 of guide 24 and by passing shaft 44 through central aperture 50 of guide 24. This coupling also retains magnets 30 within magnet slots 54. Thereby, assembly of contact housing assembly 22 is achieved.

Assembly of hermetically sealed relay 10 is further achieved through the combination of solenoid 20 and contact housing assembly 22. Solenoid 20 is placed within outer core 14 to rest upon bottom core 48. Bearing 45 is placed within central bore 21 of solenoid 20.

Shaft 44 is placed through central aperture 51 of top core 46, through plunger 42 and coupled thereto via clip 104. Contact housing assembly 22 is then placed within outer core 14. This placement includes aligning plunger 42 with central bore 21 and aligning plurality of leads 38, 39, 40 with lead notch 27 and lead notch 59. Additionally, plurality of leads 38, 39, 40 are coupled to/passed through lead bores 29 of envelope 26. Once solenoid 20 and contact housing assembly 22 are assembled within outer core 14, this assembly is placed within housing 12.

Top plate 110 then placed within housing 12. Fixed contacts 34, solenoid leads 38, 39, 40, and leads for switches 82 are fed through their respective holes 114, 118, 116. Top frame 112 is then placed such that outer rim 122 engages housing 12.

Once assembled, relay 10 is placed within an evacuation chamber in which a vacuum is applied. Optionally, the chamber and relay 10 is backfilled with another gas such as sulphur-hexafluoride. Epoxy resin 130, FIG. 1, is subsequently applied and allowed to harden to hermetically seal relay 10 and to maintain the vacuum or backfilled gas therein. An exemplary sealing process and evacuation chamber are described in U.S. Pat. No. 6,265,955 to Molyneux et al., issued Jul. 24, 2001, entitled "Hermetically sealed electromagnetic relay," the disclosure of which is incorporated herein by reference. Alternatively, a ceramic disk may be used in place of epoxy resin. Such a ceramic disk would be brazed to outer core 14 to form a ceramic to metal bond. In yet another alternative, a copper tube (not shown) is placed through tubulation clearance void 120 before the epoxy resin 130 is placed. Once epoxy resin 130 hardens, the copper tube is used to evacuate and backfill the interior of relay 10. Once backfilled, the copper tube is sealed off.

In operation, relay 10 is activated by energizing the activation coil of solenoid 20. This energizing creates electromagnetic flux at least within central bore 21. Plunger 42, being magnetically responsive, reacts to the provided flux and travels in the direction of top core 46. Top core 46 limits the travel of plunger 42. Movement of plunger 42 likewise moves attached shaft 44. Movement of shaft 44 translates movement of plunger 42 to contact carrier 28 to cause movement of contact carrier 28 toward top plate 110 within two connection voids 52. Movement of contact carrier 28 includes movement of moving contacts 32 and activation tabs 70. Prior to energizing, contact carrier 28 and moving contacts 32 are in a resting open position. After energizing, contact carrier 28 and moving contacts 32 are in an activated position such that moving contacts 32 physically and electrically abut stationary contacts 34. The activated position provides that multiple stationary contacts 34 within each of the contact sets are electrically connected and current is allowed to flow therebetween.

In the provided example, energizing of solenoid 20 causes travel of contact carrier 28 of a length greater than the distance between moving contacts 32 and stationary contacts 34 in the resting open position. Such travel is referred to hereafter as "overtravel." This overtravel causes moving contacts 32 to engage stationary contacts 34 and to subsequently at least partially compress biasing springs 36. During use, events such as arcing, as will be discussed in more detail later, and other events may cause depletions in the amount of material of moving contacts 32 that is present. Loss of moving contacts 32 material can decrease the amount of overtravel. In cases with large material loss, moving contacts 32 may sometimes no longer make contact with stationary contacts 34 and thereby maintain an open circuit in the activated position. The overtravel provides that a greater amount of material can be lost from moving contacts 32 before such an open circuit in the activated position occurs.

Placement of contact carrier 28 into the activated position also places activation tabs 70 into an activated position. Activation tabs 70 in the activated position engage whatever switches 82 are present and place them in an "on" position. Accordingly, activation of hermetically sealed relay 10 may be coordinated with the placing of switches 82 into the "on" position. Thus, accessories controlled by switches 82 can be controlled by relay 10.

Once hermetically sealed relay 10 is activated and contact carrier 28 is in the activated position, the activation coil is deactivated and the hold coil is energized. The activation coil is higher energy and produces a greater flux compared to the hold coil. Providing power to the activation coil for an extended period of time provides an increased likelihood of failure and burnout. However, the hold coil is suitable for having extended periods in an energized state. The hold coil may provide a less intense flux relative to the activation coil in that it does not need to move anything. The hold coil only needs to maintain the existing positions of the parts and thus works with inertia, not against it. The hold coil also draws less power per unit of time than the activation coil. Accordingly, use of the hold coil provides energy efficiency.

It should be appreciated that the walls of envelope 26 combined with the walls of contact carrier 28 form two electrically separate chambers of two connection voids 52. Accordingly, in the activated state, a single hermetically sealed relay 10 is provided that has and controls two isolated currents within a hermetically sealed epoxy chamber.

Figure 9:
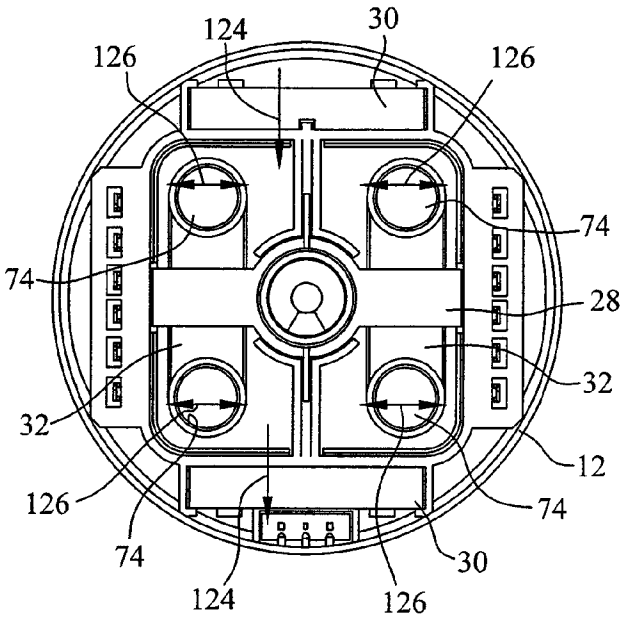
FIG. 9 is a cut away view of the relay of FIG. 1.
Figure 8:
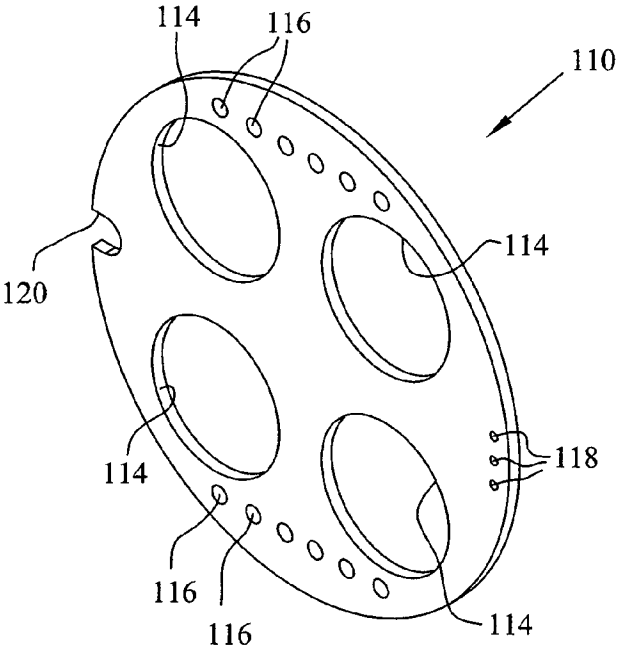
FIG. 8 is a perspective view of a top plate of the relay of FIG. 1.

Furthermore, magnets 30 act as/provide arc blow-outs. FIG. 9 shows a cut away section of hermetically sealed relay 10 including contact heads 74 of stationary contacts 34 and moving contacts 32. Magnets 30 are aligned in their polarity and create flux in the direction of arrows 124. Upon separation of moving contacts 32 and stationary contacts 34, arcing of the electrical current from moving contacts 32 to stationary contacts 34 is possible when the two components are still relatively proximate each other. Such arcing results in an electrical breakdown of a gas which produces an ongoing plasma discharge, resulting from a current flowing through normally nonconductive media such as air or whatever has been backfilled therein. Arcing results in a very high temperature, capable of melting or vaporizing virtually anything.

The applied flux from magnets 30 increases the effective distance that an arc needs to travel to span between moving contacts 32 and stationary contacts 34. The applied flux "blows" the arc to one side or the other, approximately along lines 126, depending on the polarity of the flowing current. Whereas an arc would want to travel the shortest possible distance between contacts, which is a straight line, the applied flux "blows" the path of travel to approximate a parabola, thereby effectively increasing the distance that the arc must travel. The conditions conducive to arcing are thus diminished by the applied flux. The backfilled gas is also selected to have arc resistant properties. It should be appreciated that hermetically sealed relay 10 has two directions of blow out 126 available, based on the polarity of the applied current, and that either direction works equally well such that current of any polarity is affected equally well.

While this disclosure has been described as having an exemplary design, the present disclosure may be further modified within the spirit and scope of this disclosure. This application is therefore intended to cover any variations, uses, or adaptations of the disclosure using its general principles. Further, this application is intended to cover such departures from the present disclosure as come within known or customary practice in the art to which this disclosure pertains.

The invention claimed is:

1. A relay including:

a hermetically sealed housing, a first circuit including first and second fixed contacts and a first movable contact, the first movable contact and at least part of the first and second fixed contacts being sealed within the housing;

a second circuit including third and fourth fixed contacts and a second moveable contact, the second movable contact and at least part of the third and fourth fixed contacts being sealed within the housing, the second circuit being electrically isolated from the first circuit; and an actuator sealed within the housing, the actuator coupled to a contact carrier that at least partially holds the first and second moveable contacts and translates movement of the actuator to the first and second moveable contacts, the contact carrier being in contact with a wall of the housing, the contact carrier including a wall that is between and physically isolates the first circuit from the second circuit by defining at least two separate and distinct chambers within the housing, each chamber containing one moveable contact, the actuator having a first position in which the moveable contact is electrically isolated from the first and second fixed contacts and the second moveable contact is electrically isolated from the third and fourth fixed contacts, and the actuator having a second position in which the first moveable contact is electrically coupled to the first and second fixed contacts and the second moveable contact is electrically coupled to the third and fourth fixed contacts.

2. The relay of claim 1, wherein at least part of a hermetic seal of the hermetically sealed housing is formed from an epoxy to metal bond.

3. The relay of claim 1, wherein at least part of a hermetic seal of the hermetically sealed housing is formed from a ceramic to metal bond.

4. The relay of claim 1, further including at least one permanent magnet.

5. The relay of claim 4, wherein the at least one magnet provides arc blow-out, the magnet, first and second moveable contacts, and four fixed contacts being positioned such that the arc blow out is equally effective regardless of the polarity of the current within the first and second circuits.

6. The relay of claim 1, wherein the wall is moveable relative to the fixed contacts.

7. A relay including: a housing a first circuit including first and second fixed contacts;

a second circuit electrically isolated from the first circuit, the second circuit including third and fourth fixed contacts;

a first moveable contact, the first moveable contact positionable in a first area proximate the first and second fixed contacts to complete a circuit between the first and second fixed contacts and positionable in a second area away from the first fixed contact; a contact carrier including a wall that is between and physically isolates the first area from the third area by defining at least two separate and distinct chambers within the housing, each chamber containing one of the first and second moveable contacts, a second moveable contact positionable in a third area proximate the third and fourth fixed contacts to complete a circuit between the third and fourth fixed contacts and positionable in a fourth area away from the third fixed contact; and at least one magnet, the at least one magnet applying a flux to the first area and the third area, the flux achieving a first efficacy for arc blow out for a first polarity, the flux achieving a second efficacy for arc blowout for a second polarity, the first efficacy being substantially equal to the second efficacy and the first polarity being opposite of the second polarity.

8. The relay of claim 7, wherein the first moveable contact is electrically isolated from the second moveable contact.

9. The relay of claim 7, wherein the first and second moveable contacts are moved by a common actuator.

10. The relay of claim 7, wherein the first and second moveable contacts are located within the contact carrier, the contact carrier providing electrical isolation between the first and second moveable contacts.

11. The relay of claim 7, wherein the first moveable contact, and the magnet are hermetically sealed within a housing.

12. The relay of claim 7, wherein the first, second, third, and fourth fixed contacts are generally arranged to form a square such that the first and second fixed contacts are aligned in a first direction, the third and fourth fixed contacts are aligned in the first direction, the first and third fixed contacts are aligned in a second direction that is perpendicular to the first direction, and the second and fourth fixed contacts are aligned in the second direction.

* * * * *